United States Patent [19]

Slade et al.

[11] 4,025,883

[45] May 24, 1977

[54] MODULAR INTEGRAL MOTOR CONTROLLER

[75] Inventors: Paul G. Slade, Pittsburgh; John A. Wafer, Monroeville, both of Pa.

[73] Assignee: Westinghouse Electric Corporation, Pittsburgh, Pa.

[22] Filed: Nov. 11, 1975

[21] Appl. No.: 630,874

[52] U.S. Cl. ..... 335/16; 335/132; 335/178; 335/202; 361/115

[51] Int. Cl.[2] ..... H01H 77/10

[58] Field of Search ..... 335/16, 18, 195, 147, 335/177, 178, 179, 180, 181, 132, 202, 136; 317/58

[56] References Cited

UNITED STATES PATENTS

| | | | |
|---|---|---|---|
| 3,136,921 | 6/1964 | Dorfman et al. | 335/195 |
| 3,539,867 | 11/1970 | Edmunds | 335/18 |
| 3,663,903 | 5/1972 | Kussy et al. | 335/16 |
| 3,761,778 | 9/1973 | Willard | 317/58 |
| 3,815,059 | 6/1974 | Spoelman | 335/16 |
| 3,824,508 | 7/1974 | Terracol | 335/16 |

*Primary Examiner*—Harold Broome
*Attorney, Agent, or Firm*—Robert E. Converse, Jr.

[57] ABSTRACT

A motor controller providing a disconnect and a single set of movable contacts, to provide operation and protection of a motor and associated circuitry over a complete range of possible currents. Plug-in modules for a circuit disconnect, a solid state overload relay, and an instantaneous trip unit are provided. The disclosed integral modular motor controller consists of five major components: (1) an isolator switch, (2) arc chambers, (3) a linear slot motor drive, (4) a drive operator, and (5) a solid state control. For a normal motor starting operation and for fault currents up to a predetermined value, such as 1200 amperes, an electromagnetic actuator is used to open the contacts a relatively small distance such as 0.25 inch. For higher fault currents a drive or linear slot motor opens the contacts to a greater separation such as 1 inch. The disclosed modular integral motor controller utilizes a disconnecting switch connected in series with a movable bridging contact arm on which arm mounted a pair of spaced apart movable contacts aligned to engage a pair of stationary contacts when the motor controller is in the closed position to complete an electric circuit to the controlled motor. The bridging contact arm is provided with two open positions; one for use in motor control and relatively low fault currents, wherein relatively small contact separation is involved, and a second open position used during high fault currents and current limiting situations, wherein the movable contacts are separated from the stationary contacts by a relatively large separation.

16 Claims, 12 Drawing Figures

MODULAR INTEGRAL MOTOR CONTROLLER

CROSS-REFERENCE TO RELATED APPLICATIONS

The invention disclosed in the instant application is related to the following:

1. U.S. Patent application Ser. No. 613,840;
2. U.S. Patent application Ser. No. 503,232;
3. U.S. Patent application Ser. No. 533,413; and
4. U.S. Patent application Ser. No. 587,791.

BACKGROUND OF THE INVENTION

1. Field of the Invention:

This invention is related to combination motor starters and more particularly to an integral modular motor controller wherein a single unit provides for complete protection and operation of a motor and associated circuitry over the entire current range.

2. Description of the Prior Art

Prior art combination motor starters as exemplified by U.S. Pat. No. 3,638,157 issued to Z. J. Kruzic are provided with separate units which provide for motor starting and stopping, current interruption, and current limiting. It is old in the art to provide a combination motor starter having a plurality of motor control and circuit protection devices connected in series in a common enclosure for complete motor and circuitry protection. It is old in the art to provide a fused switch motor starter combination comprising a contactor, with series connected overloads to automatically open the contactor during lesser overload current caused by motor overload, current limiting fuses, for interrupting high level fault current, and a manual operable switch, for permitting manual opening and closing of the motor circuit. It is also old to provide a fuse breaker combination motor starter comprising a contactor, with overload relays for opening the motor circuit upon the occurrence of lesser overload currents, a manually operable circuit breaker automatically operable to interrupt the motor circuit upon the occurrence of low level to high level fault currents, and current limiting fuses that operate upon the occurrence of high level short circuit currents. Prior art motor starters normally comprise a load-break device which usually has silver cadmium oxide, AgCdO, contacts or the like for low contact resistance. An electromagnet mechanism is used to open and close the contacts. Contacts are spring biased opened and are automatically opened if system voltage is lost. Low to high level fault current protection is provided by a series connected molded case circuit breaker. The molded case circuit breaker can be a single break deion circuit breaker with an adjustable magnetic trip. For long life and durability, silver tungsten contacts are often used in the circuit breaker. The adjustable magnetic trip can be set to operate the breaker from 7 to 13 times overload current. The molded case circuit breaker is capable of numerous operations interrupting high overloading currents. For example, the breaker used on a NEMA Size I starter having a 100 ampere rating can interrupt currents up to 15,000 amperes up to three times. Current limitation is provided by current limiting fuses connected in series with the contactor and molded case circuit breaker for protection against possible fault currents up to 100,000 amperes rms. In addition a thermal overload relay which can be adjusted to open the motor starter at currents below the molded case circuit breaker rating with an appropriate time delay is provided. It is also common to provide a series connected disconnect switch for isolating the other components.

In the prior art it is necessary to use a plurality of circuit protection and motor control devices to provide for complete protection and operation of the motor and associated circuitry over the entire current range.

SUMMARY OF THE INVENTION

An integral modular motor controller is disclosed which provides for protection and operation of the motor and associated circuitry over a complete possible current range. The disclosed integral modular motor controller comprises (1) an arcing chamber wherein contact separation and arc extinction occur; (2) a high speed drive for current limitation wherein a slot motor drives a bridging contact arm rapidly open to open the circuit and provide current limitation; (3) a disconnect which isolates the motor controller contacts from the line in order to provide added safety when the contacts are inspected or replaced; (4) an electromagnet for normal motor starting contactor operation and which also opens the motor starter circuit during overload current situations when deenergized by the solid state trip system; (5) a solid state trip circuit which is used to switch the electromagnet on and off and also to trip the solenoid open with an appropriate time delay on motor overloads or as quick as possible on short circuits.

The disclosed modular motor controller can be a single phase device or a multiphase device as required. The disclosed motor controller incorporates a disconnect, a solid state overload control, an instantaneous trip, a current limiting function, and a motor starter function, thus providing all of the functions of the prior art combination motor controllers. The disclosed motor controller utilizes a movable contact mechanism which is operable by a first operator for normal operation and circuit protection up to a predetermined overload current value and which is operable by a second magnetic driving operator or slot motor for circuit protection above the predetermined overload current value, and having a disconnect mechanism connected in series with the movable contact mechanism to provide isolation. The first operator moves the contact mechanism to a position of relatively small separation from the stationary contacts and the second operator moves the movable contact mechanism to a relatively large separation from the stationary contacts when the predetermined current value is exceeded.

The integral motor controller disclosed in the instant application utilizes a movable contact arm having a movable contact attached thereto and being constructed for moving the movable contact into and out of engagement with a stationary contact. An electromagnet is associated with a movable contact arm for moving the movable contact arm to the open or closed position to control motor operation and provide circuit protection is some instances. The magnetic driving means is coupled to the movable contact arm to move the movable contact arm to the open position under high current fault conditions.

The electromagnet moves the movable contact arm to a position wherein the contacts are separated by a small separation and the magnetic drive means can move the movable contact to an open position wherein the contacts are separated by a greater separation. The operating range of the electromagnet operator and the magnetic drive means overlap slightly to provide for complete protection of the motor control circuit over a wide continuous current range. A magnetic or spring latch is provided for latching the contact arm in the closed position. A latch biasing spring is provided between the contact arm and the magnetic latch for biasing the movable contact arm to the closed position. The electromagnet is provided with a spring which biases the contact arm to the open position. With the electromagnet deenergized, the electromagnet spring is strong enough to move the movable contact arm to the open position. The electromagnet spring overcomes the force provided by the latch biasing spring and moves the contact arm to the open position without tripping the magnetic latch. When the motor starter is opened by the magnetic driving device, the magnetic latch is tripped and the contact arm is moved to a relatively greater distance than that provided by operation of the electromagnetic or solenoid operator. Before the integral motor controller can be closed again the latch must be reset. This assures that the magnetic driving device for providing protection against high overload currents is always ready for operation before the electromagnet can cause the integral motor starter to close. Where the term electromagnet is used herein it is intended to include any electro-mechanical device which has a shaft positionable in an extended position or retracted position when activated.

It is an object of this invention to teach an integral motor starter having a electromagnet for providing for motor operation and protection up to a predetermined overload current level and a magnetic drive device for providing for current limiting and circuit protection for all currents above the predetermined overload level, with an integral disconnect switch for providing for isolation of the motor starter contacts.

It is an object of this invention to teach a combination motor starter for providing for complete motor and circuit protection over a wide current range which can be constructed from modular components.

BRIEF DESCRIPTION OF THE DRAWINGS

For a better understanding of the invention reference may be had to the preferred embodiment exemplary of the invention shown in the accompanying drawings, in which.

DESCRIPTION OF THE PREFERRED EMBODIMENT

Figure 1:
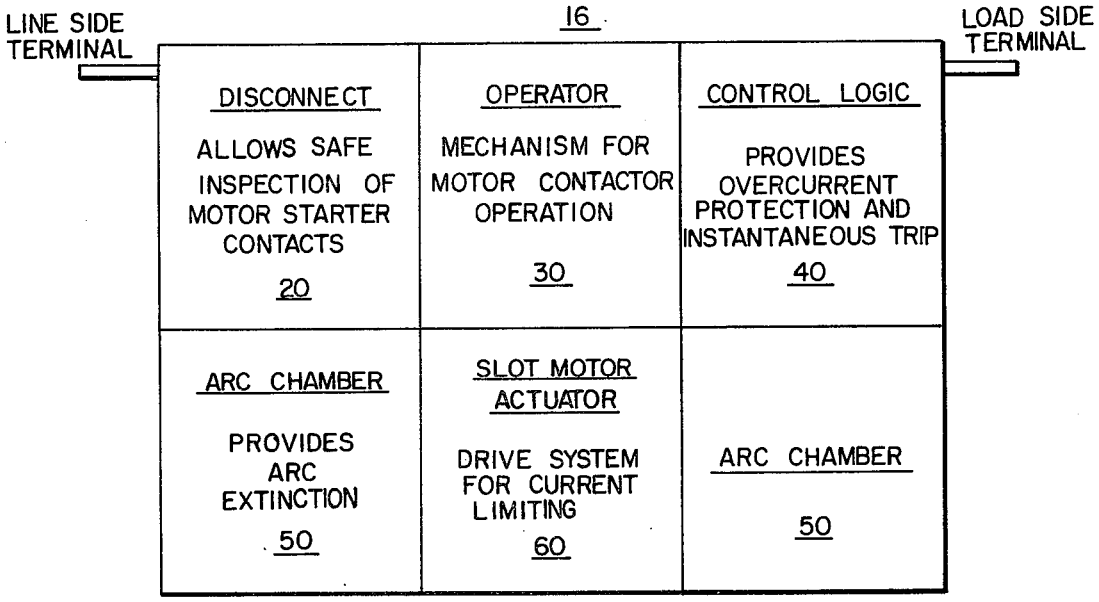
FIG. 1 is a block diagram of the disclosed integral motor controller.

Referring now to FIGS. 1 through 10 there is shown an integral motor controller 16 utilizing the teaching of the present invention. FIG. 1 shows a block diagram of the disclosed integral motor controller 16 which comprises an isolator or disconnect switch 20, an electromagnet or solenoid operator 30, control logic 40, arc chambers 50 and slot motor actuator 60.

Figure 2:
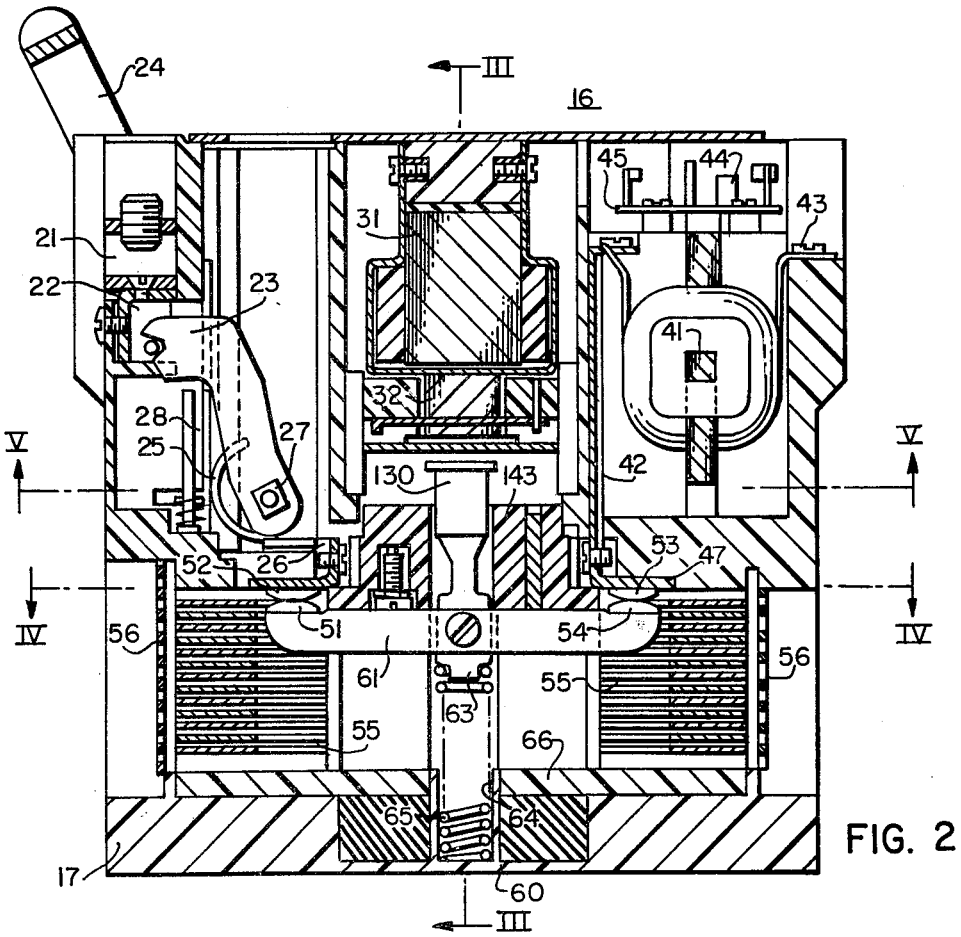
FIG. 2 is a vertical section view through the integral motor controller disclosed in the instant application.

Referring now to FIG. 2 there is shown an integral motor controller 16 utilizing the teaching of the present invention and having a housing 17. When motor controller 16 is inserted in a circuit a line connection is made to terminal 21. Terminal 21 is electrically connected to a spring clip contact 22. A movable contact blade 23 which is movable in response to positioning of a handle 24 engages spring clip 22 when in the closed position. Handle 24 is connected to a common shaft 27 on which a contact blade 23 for each switch is mounted. As handle 24 is moved clockwise as shown in FIG. 2 contact blade 23 is disengaged from spring clip 22, isolating the rest of controller 16 from the line side connection at terminal 21. A flexible conductor 25 connects contact blade 23 to an L-shaped conductor terminal 26. A fixed contact 52 is supported from L-shaped conductor 26. Another stationary contact 53 is spaced apart from the stationary contact 52 and is supported on an L-shaped conductor 47. A bridging contact arm 61 having contacts 51 and 54 mounted therein can complete an electrical circuit between relatively stationary contacts 52 and 53. A current transformer 41 is connected in series with conductor 47 by an elongated conductor 42. Current transformer 41 has its primary winding connected between line terminal 43 and conductor 42. Thus it can be seen that with the integral motor starter 16 in the closed position, as shown in FIG. 2, a continuous electrical path exists from line terminal 21, through bifurcated clip connector 22, through contact blade 23, through flexible conductor 25, through L-shaped conductor 26, through fixed contact 52 which engages contact 51, from contact 51 through bridging contact arm 61 to movable contact 54 which engages fixed contact 53, from contact 53 through L-shaped conductor 47, through elongated conductor 42, through current transformer 41 to load terminal 43. During normal operation and circuit protection operation contact is made or interrupted between contact pairs 51–52 and 53–54. When the contacts are to be inspected or the motor controllers to be partially disabled, isolator handle 24 is switched to the open position isolating the rest of motor starters 16 from incoming line terminal 21 and spring clip 22.

A similar contact and isolator is provided for each phase of a three phase unit. Positioning of the movable contact arm 61 is controlled by a magnetic drive, or slot motor 60 or by a solenoid 31. A sliding guide shaft 63 is provided to move within a circular opening 64 of slot motor 60. The bridging contact arm 61 can be held to guide shaft 63 by a screw and lock washer, by a rivet, or by other suitable fasteners. Contact force is applied to guide shaft 63 to provide for proper engagement of contact pairs 51–52 and 53–54 by a compression spring 65. The end of compression spring 65 not in engagement with guide shaft 63 rests upon the base of the motor controller 16 housing. The slotted laminated yoke 62 of slot motor 62 has a nylon bumper 66 disposed at the base of the slot 68. The slot 68 is shown more clearly in FIG. 4. For fault currents greater than, for example 1200 amperes, the magnetic drive yoke 62 draws contact arm 61 into the slot approximately 1 inch. A latching spring such as disclosed in copending U.S. Patent application Ser. No. 598,618, holds bridging contact arm 61 in the open position when tripped by slot motor 60. Magnetic drive or slot motor 60 requires no triggering and automatically moves bridging contact arm 61 to the open position when current flow through the contact arm 61 exceeds a predetermined value. Initial level of operation of slot motor 60 depends primarily on the slot width in yoke 62 and the cross-section of bridging contact arm 61. The operation of magnetic drive or slot motor 60 is disclosed more fully in copending U.S. Patent application Ser No. 503,232.

Figure 3:
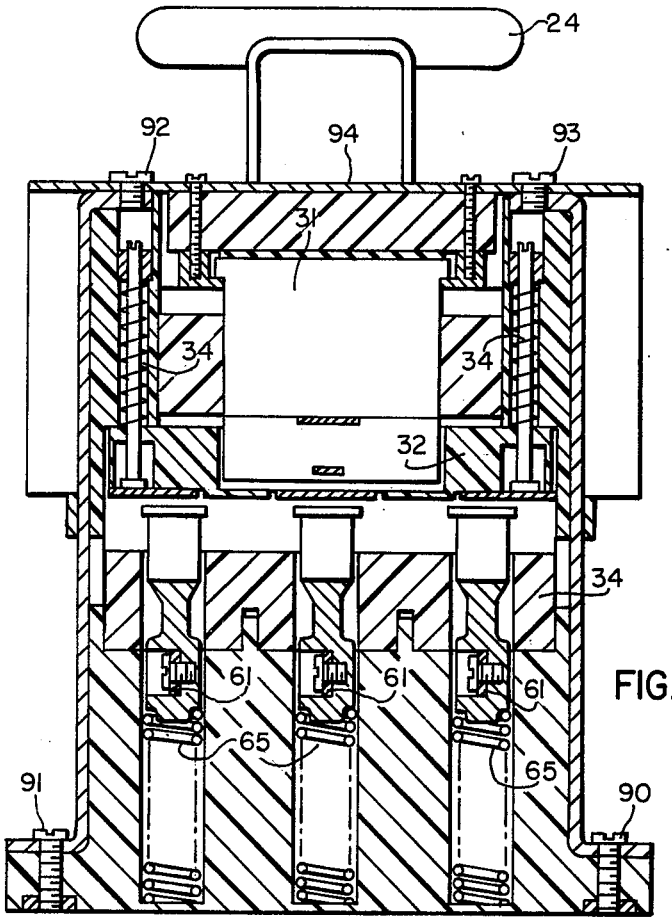
FIG. 3 is a view of the motor controller shown in FIG. 2 along the lines III—III.

A solenoid 31 is provided for motor starting and stopping, motor overload interruption, and low fault current interruption. When solenoid 31 is deenergized, contact arm 61 is moved to the open position by the solenoid actuator 32 impinging on nylon stopper 130 which is connected to guide shaft 63. Solenoid 31 is mounted so that when solenoid 31 is energized, actuator 32 is retracted and spring 65 causes bridging contact arm 61 to move to the closed position. The actuator 32 is spring biased to an extended position engaging and moving nylon stop 30 and guide shaft 63. The spring biasing force on actuator 32 is greater than the biasing force provided by spring 65 so that when solenoid 31 is deenergized, bridging contact arm 61 is forced to the open position wherein contacts 51 and 54 are spaced apart from contacts 52 and 53, respectively. The spring biasing force for actuator 32 is provided by springs 34 for a three phase unit. As shown in FIG. 3, actuator 32 opens the circuit to all three phases when extended. During high current faults the bridging contact arm 61 is driven down into the slot 68 in magnetic yoke 62 and is prevented from reclosing by a spring clip housed in glass polyester holder 134. During circuit interruption when contact pairs 51–52 and 53–54 separate, serially related arcs are formed therebetween. Deion plates 55 located in proximity to the contacts 51, 52, 53, and 54 quickly engage and extinguish any arc formed during circuit interruption.

Figure 4:
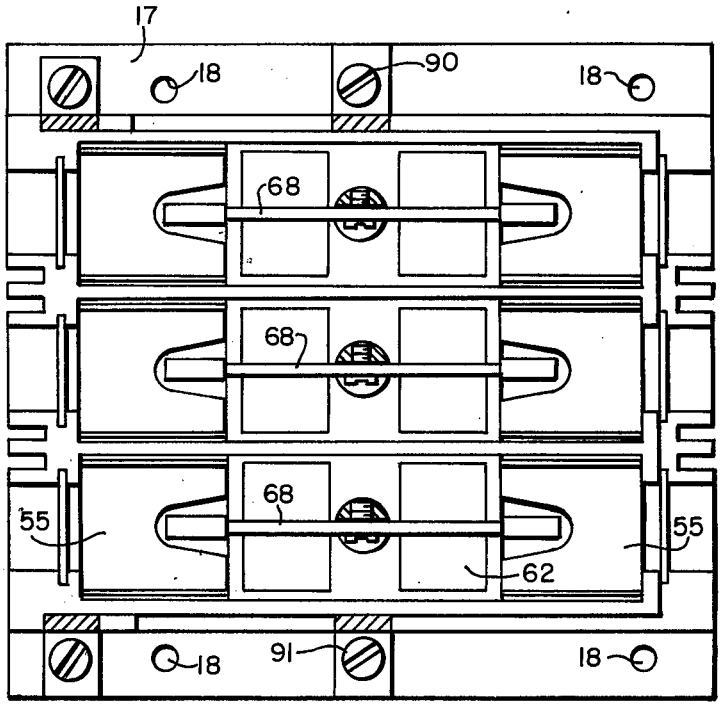
FIG. 4 is a view of the motor control as shown in FIG. 2 along the lines IV—IV.
Figure 5:
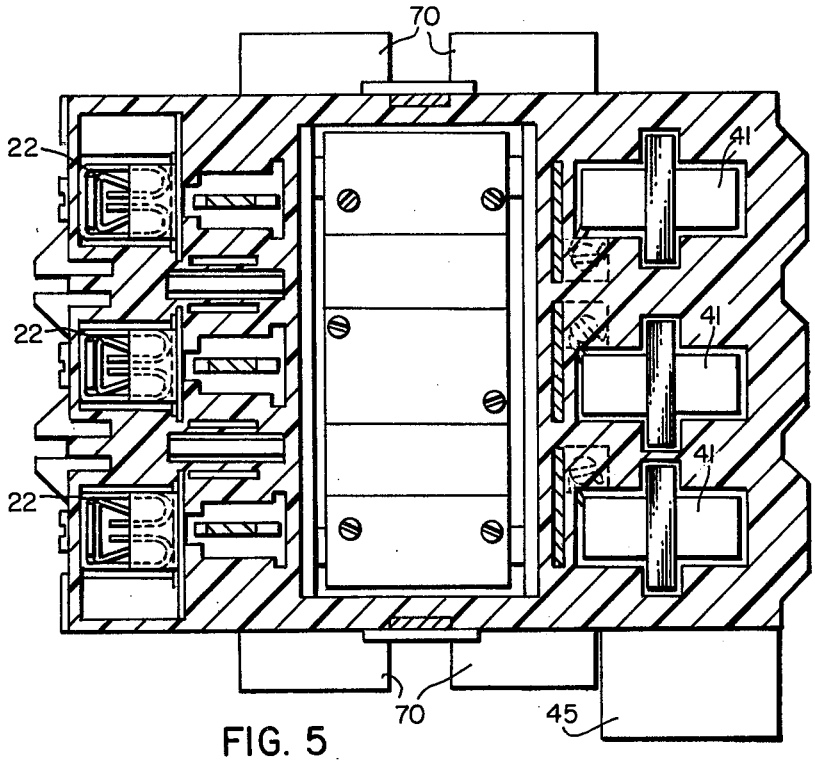
FIG. 5 is a view of the motor controller as shown in FIG. 2 along the lines V—V.
Figure 6:
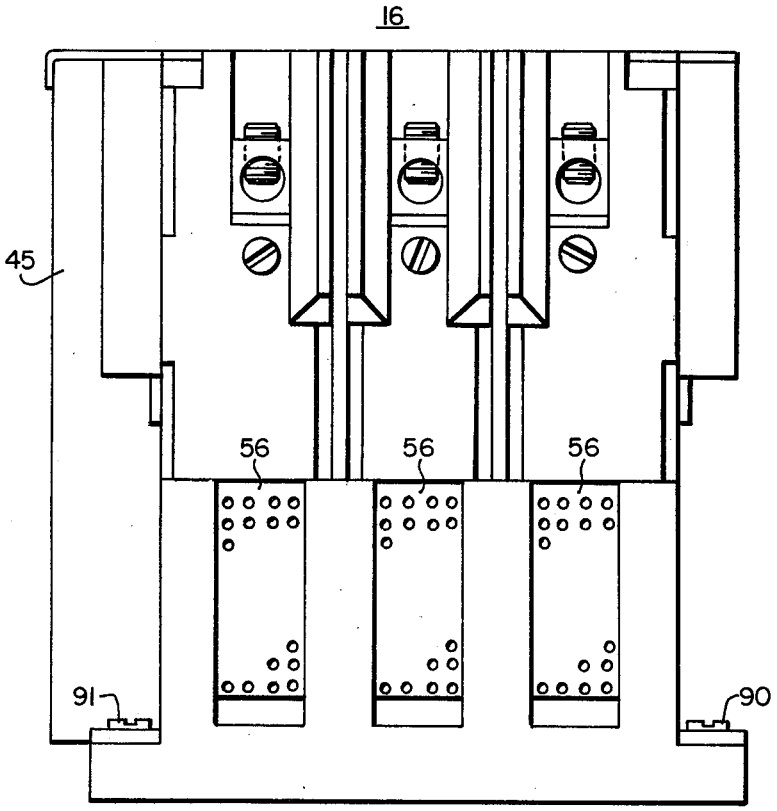
FIG. 6 is an end view of the circuit interrupter shown in FIG. 2.

Operation of solenoid 31 can be controlled by an external signal or by a trip signal generated internally. A solid state control package 40 mounted on a circuit board 45 is fed from current transformer 41 through a rectifying network 44 and when an overload persists for a selected period of time trips open solenoid 31. The current transformer 41 are fitted in slotted grooves formed in the glass polyester housing. Referring now to FIG. 4 there is shown a view looking along the lines IV-IV of FIG. 2. The glass polyester housing 17 in which mounting holes 18 are formed can be seen. Mounting holes 18 are used to mount the integral motor controller 16 in an enclosure. FIG. 5 shows a view along V—V of FIG. 2. The circuit board 45 is shown mounted to one side of control transformers 41. The rectifier bridge circuit 44 is mounted above transformers 41 and is not shown in FIG. 5. Holders 70 for up to four auxiliary contacts can clearly be seen in FIG. 5. FIG. 6 shows an end view of the modular controller 16. The glass melamine arc baffles 56 which are mounted along the outside of deion plates 55 can be seen.

Figure 7:
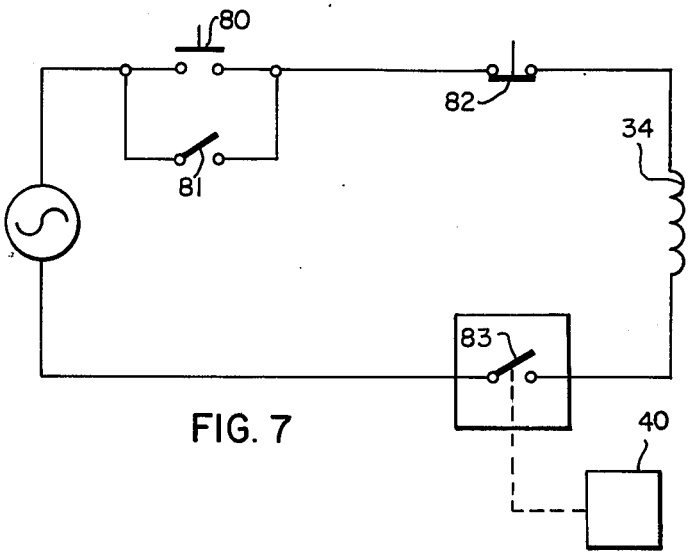
FIG. 7 is a schematic of a control and trip circuit that can be used for controlling the solenoid of the disclosed integral motor controller.

A control and trip circuit for use with the solenoid 31 of the disclosed motor starter is shown in FIG. 7. Solenoid 31 has a solenoid coil 34 which when energized moves actuator 32 to the retracted position. The solenoid coil can be energized by depressing start button 80 which causes solenoid coil 34 to energize, closing contacts 81 and sealing itself in. Solenoid coil 34 can be deenergized by depressing stop button 82. Buttons 80 and 82 can be provided on the motor starter enclosure or at a remote location. A set of solid state or mechanical normally-closed contacts 83 can be controlled by a signal from control logic 40 to deenergize solenoid coil 34. For a motor overload tripping operation a motor overload condition will be sensed by the current transformer and solid state circuitry 40. This will result in deenergizing of the solenoid 34 after an appropriate time delay, which depends on the magnitude of the overload. Contacts 83 must be reset with a pushbutton provided on the enclosure or remotely on a control panel before solenoid coil 34 can be again energized to control the associated motor. In the range of six times full load motor current to approximately 1200 amperes the solid state circuitry 40 provides what is called an instantaneous trip signal by deenergizing the electromagnet or solenoid 31. The solenoid is deenergized without any intentional time delay. For this condition the starter 16 will have to be reset before the motor can be restarted. For a short circuit trip in the range of for example fault currents of 1200 amperes to over 100,000 amperes the linear slot motor 60 automatically drives the contact arm 61 open a full one inch of travel. Current limiting is provided in this range. When the movable contact arm 61 opens, electromagnet 32 is deenergized automatically. The latch holding the movable contact arm 61 in the open position will have to be reset before the motor starter can again be operated. After the spring latch is reset the overload contact must also be reset.

A single plug-in resistor module can be used to set the continuous rating. A resistor module can be made available for each of the present day heater ratings. A potentiometer can be adjusted to vary the rating a small amount either way. The rating of the plug-in resistor can also automatically set the instantaneous trip level.

Figure 8:
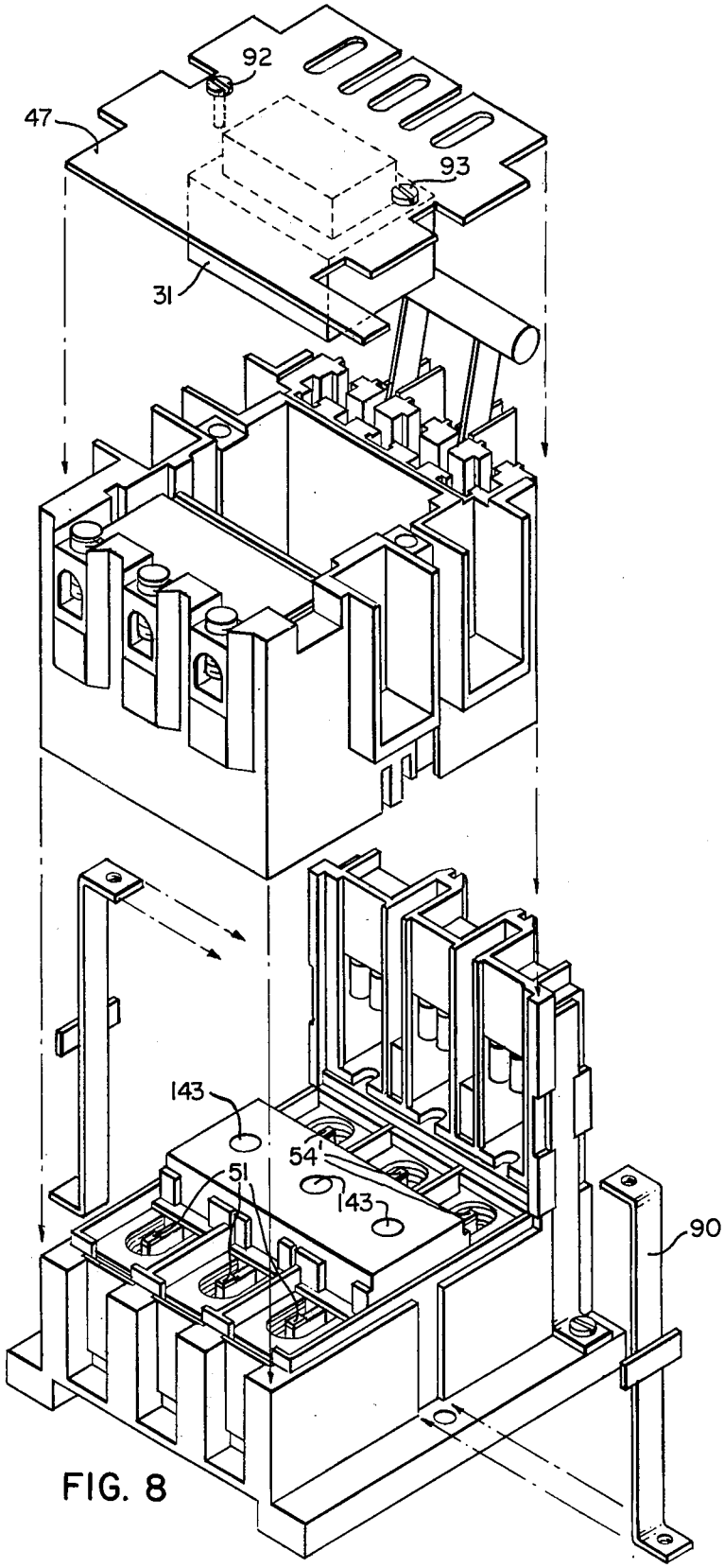
FIG. 8 is a perspective view of the integral motor controller.

For contact inspection the blade contact 23 has to be separated from bifurcated clip 22. This is done by rotating the operating handle 24, as shown in FIG. 2, in a clockwise direction. Two screws 90 and 91 are then taken out and the whole top housing assembly as shown in FIG. 8 can be lifted off in one piece. As shown in FIG. 8 this exposes contacts 51, and 54. As the top portion is lifted off a spring biased shutter 28 (FIG. 2) covers the exposed spring clip contact 22. To replace a moving contact only two screws holding the latch housing 143 in place have to be removed and the latch housing can then be lifted off. The whole movable contact assembly, including contact arm 61 and guide 63, will then lift out. A single screw holds each fixed contact in place. To replace a current transformer 41, disconnect handle 24 must be in the off position. Fasteners 92 and 93 can then be removed and the top plate 94 can be pulled off. A board containing the bridge circuit 44 is then exposed. The bridge circuit can then be removed and afterwards current transformer 41 can be removed by taking out the line connecting screws and sliding the current transformer from the housing. Solenoid 31 is attached to lid 47 so when lid 47 is taken off the solenoid assembly is also removed. Parts of the solenoid can then be replaced. The whole solid state package 45 can be attached by plug-in connections.

The disclosed integral motor controller has many advantages over prior art control systems such as smaller size, elimination of the need to replace fuses, elimination of heater burnout, elimination of welding on short circuit, elimination of the need to coordinate the fuse choice with the heater element rating, and elimination of the magnetic trip adjustment since a single trip adjustment is provided on the solid state control only. The instantaneous trip levels are automatically set when full load current rating is changed with plug-in resistor cards. Multiple current limiting operations are provided up to 100,000 ampere. Additional features such as reverse phasing protection and solenoid coil protection can be added with a relatively small increase in cost. The hybrid construction of the electromechanical system for interrupting currents and the solid state system for sensing and control permit great flexibility for the integral unit especially in automated computer control systems and the modular construction makes the interchanging of components an easy operation and eliminates the need for interwind.

Figure 11:
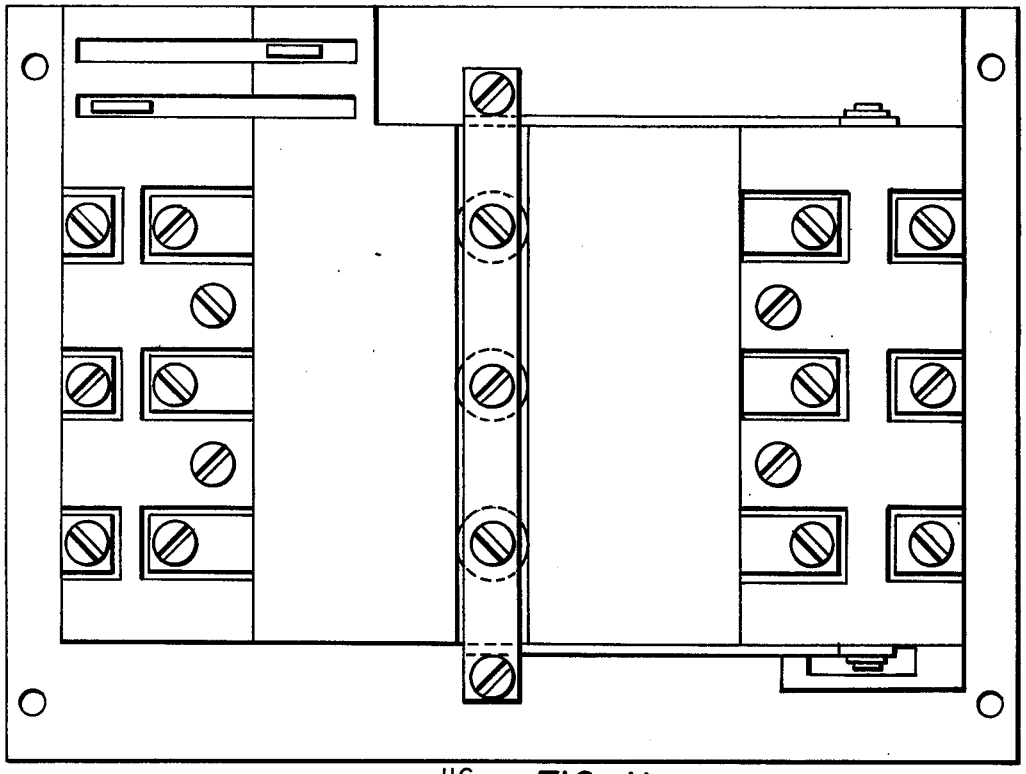
FIG. 11 is a top view of the motor controller shown in FIG. 9.
Figure 12:
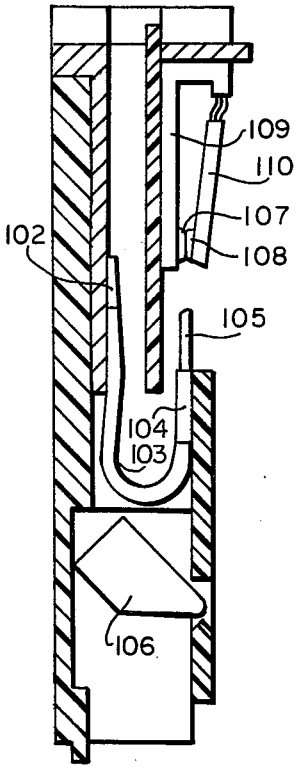
FIG. 12 is an enlarged view of the disconnect portion of the motor controller shown in FIG. 11.
Figure 9:
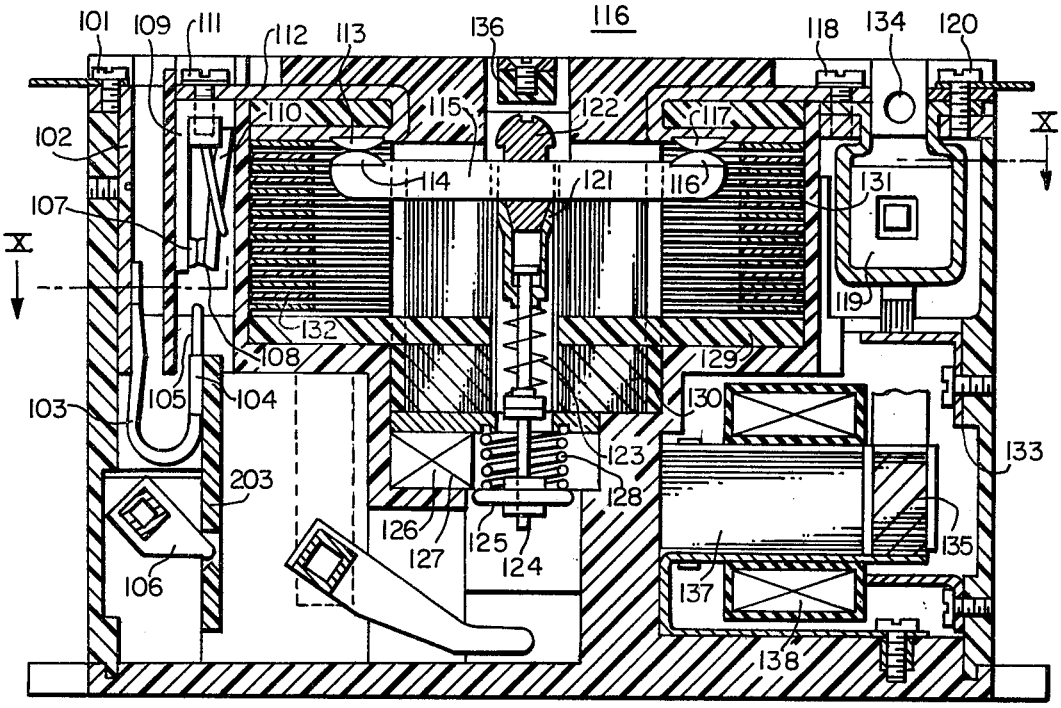
FIG. 9 is a side view of another embodiment of an integral motor controller.
Figure 10:
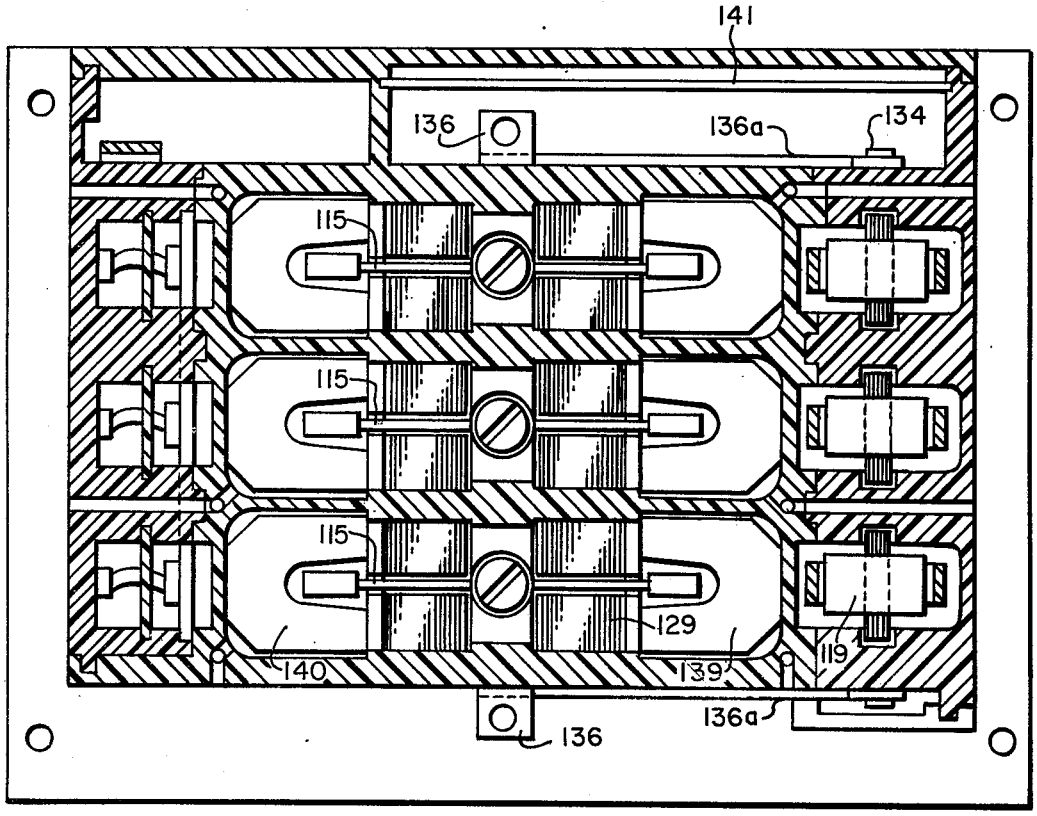
FIG. 10 is a top view of the motor controller shown in FIG. 9 along the line X—X.

Referring now to FIGS. 9, 10, 11 and 12 there is shown another embodiment of the present invention. FIG. 9 shows a cross-section of this embodiment of the integral motor controller 116. The current enters on the line side at a screw on terminal 101. It then passes through a conductor 102 and a flexible connector 103 to a movable contact arm 104 and contact tip 105. The movable contact arm 104 is actuated manually by a lever 106. There are two stationary contacts 107 and 108. The current divides between the two stationary contacts 107 and 108 and passes through two conductors 109 and 110 to a common terminal 111. This is equivalent to the isolator portion of the device shown in FIG. 1. The current then passes through the conductor 112 to silver cadmium contacts 113 and 114. A current path extends through a movable contact arm 115 to another set of contacts 116 and 117 to a conductor terminal 118. From terminal 118 the current path extends through the primary of current transformer 119 which may vary from one to six turns. The other lead of current transformer 119 is connected to the output line terminal 120. An identical current path is provided for each of the three phases. Contact arm 115 is held on shaft 121 by a screw-in button 122. The contact force is applied to the shaft by a compression spring 123 which is connected to a second shaft 124. A keeper 125 is also attached to this shaft which is latched by a permanent magnet assembly consisting of two magnets 126 and 127 and two pole pieces (not shown). A second compression spring 128 is also latched by the keeper. This spring holds the contacts open after the keeper has been unlatched. A laminated linear slot motor yoke 130 has a nylon bumper 129 at the base of the slot. Spaced conductive arc-extingiushing plates 131 and 132 are fitted in proximity to the contacts 113, 114, 116 and 117. The three current transformers 119 are held by a common bracket 133. An L-shaped rocker mechanism is pivoted on shaft 134 and has a keeper 135 at one end and a crossbar 136 at the other end (attached by a connecting arm 136*a* to the shaft 134) to actuate the contact arms 115. A solenoid coil 138 and laminated stator 137 are mounted so that when the solenoid coil 138 is energized the keeper 135 is closed and the crossbar 136 retracts allowing the contacts 113, 114, 116, and 117 to close. The keeper 135 is biased with two compression springs so that when the solenoid is deenergized the keeper 135 moves to an open position pushing the contact arm button 122 with the crossbar 136 and thereby opening the contacts. The solenoid coil 138 actuates all three phases. FIG. 10 shows the cross-sectional view of the device shown in FIG. 9. It can be seen that each phase has a movable contact arm 115, a slot motor yoke 129, spaced arc-extinguishing plates 139 and 140, and a current transformer 119. A circuit board 141 contains a solid state relay and instantaneous trip circuitry. FIG. 11 shows a top view of the disclosed modular circuit interrupter 116. FIG. 14 shows an enlarged view of the disconnect switch utilized. The disconnect switch is interlocked with the door handle of enclosure so that is opened before the door can be opened. The disconnect switch has the following requirements: (1) it should remain closed without welding for currents up to the maximum let-through of the combination starter 116, (2) it should be capable of interrupting currents up to six times rated currents, (3) it should be small in size so as not to increase the overall size of the combination motor starter 116. The current passes through a conductor 102 and a flexible lead 103 to a movable contact arm 104 and a contact 105. The stationary contact pair 107 and 108 is spring loaded to make contact on each side of the moving contact 105. The conductors 109 and 110 on which the stationary contact 107 and 108 are mounted are oriented so as to be pulled together by self-induced magnetic force thereby increasing the contact force at high currents. The conductors 109 and 110 are joined to a common terminal 111. An actuator arm 106 is provided for operating the disconnect switch. A disconnect switch similar to that shown in FIG. 12 has been constructed and tested. The switch remained closed without welding for currents up to 14,000 amperes, and successfully interrupted currents up to 550 amps, which is considerably higher than the six times rated current for a Size I motor starter.

Thus it can be seen that the disclosed integral motor controller fhas five main sections:

1. The arcing chambers 50 which have contacts that allow for the normal operation and spaced conductive arc-extinguishing plate assemblies that provide a means of current interruption and current limitation in combination with the slot motor action;

2. A high speed slot motor drive 60 for current limitation in which a slot motor drives the bridging contact arm, thereby opening the contacts rapidly under short circuit conditions;

3. An isolator, or disconnect switch, system 20 which isolates the contacts from the line in order to provide safety when the contacts are inspected or replaced;

4. A solenoid operator 30 for normal on-off motor operation and which also opens the motor circuit when deenergized by the solid state trip system;

5. A solid state control circuit 40 which can have a triac which is used to turn the solenoid on and off and also to trip with an appropriate time delay on motor overload or instantaneously on short circuit current.

We claim as our invention:

1. An integral motor starter comprising:

a housing;

a stationary contact;

a movable contact;

a disconnect switch mounted within said housing and connected in series circuit relationship to said stationary and movable contacts;

a movable contact arm having said movable contact mounted thereon, movable between a closed position, wherein said movable contact and said stationary contacts are in engagement, and an open position wherein said movable contact is spaced apart from said stationary contact;

magnetic drive means magnetically coupled to said contact arm for moving said contact arm to the open position when current flow through the integral motor starter exceeds a predetermined level;

a current sensor disposed in said housing and providing an output related to the level of current flow through the motor starter;

an operator connected to said movable contact arm controlling the positioning of said movable contact arm when the current flow is below the predetermined level; and solid state circuitry connected between said current sensor and said operator for causing said operator to move said movable contact arm to the open position for overload currents below the predetermined level.

2. An integral motor starter as claimed in claim 1 wherein:

said operator comprises a solenoid, spring biased to an extended position wherein said movable contact arm is held spaced apart from said stationary contact arm by a first separation; and said magnetic drive means when operable moves said movable contact arm to an open position wherein said movable contact arm is held spaced apart from said stationary contact arm by a second separation greater than the first separation.

3. An integral motor starter as claimed in claim 1 wherein said magnetic drive means comprises:

a plurality of U-shaped laminations stacked to form a slotted member having said movable contact arm disposed within the slot.

4. An integral motor starter as claimed in claim 1 wherein said disconnect switch comprises:

a pair of contacts biased together; and an elongated movable contact movable between an engaged position disposed between said contacts and a disengaged position separated from said pair of contacts.

5. An integral motor starter as claimed in claim 1 comprising:

a latch movable to a latched position and an unlatched position;

a spring disposed between said latch and said contact arm biasing said contact arm to the closed position when said latch is latched.

6. A motor starter for operating and protecting a motor over an entire possible current range comprising:

a housing;

a line terminal adapted for connection to a source of electrical energy;

a load terminal adapted for connection to an electrical load;

a bridging contact arm movable between an open position and a closed position;

a pair of movable contacts spaced apart on said bridging contact arm;

a pair of stationary contacts aligned with said pair of movable contacts;

a disconnect switch connected in series between said line terminal and said contacts, said disconnect switch being operable between open and closed positions, said disconnect switch being operable to electrically isolate said contacts from said line terminal when said disconnect switch is in the open position;

a magnetic drive member formed of a magnetizable material having a slot formed therein, within which is mounted a portion of said bridging contact arm, constructed to drive said bridging contact arm to the open position when current through the motor starter exceeds a selected overload level; and operating means connected to said bridging contact arm for moving said bridging contact arm to the open position for current overload below the selected overload level and for moving said bridging contact arm between open and closed position during normal motor control operation.

7. A motor starter as claimed in claim 6 comprising:

a plurality of spaced arc-extinguishing plates disposed in proximity to said pair of movable contacts and said pair of stationary contacts;

and said operating means comprises, a current transformer connected in series in the motor starter providing an output which is a function of current;

solid state logic means connected to receive the output signal of said current transformer and providing a trip signal which is a function of time and current for all overload currents below the selective overload level; and a solenoid connected to said solid state logic means and said bridging contact arm for opening said bridging contact arm in response to the trip signal.

8. A motor controller comprising:

a housing;

a first pair of disconnecting contacts being relatively movable disposed within said housing and adapted for connection to a source of high potential;

first operating means connected to said first pair of contacts for opening said first pair of contacts when desired;

a stationary contact;

a movable contact being relatively movable between closed and open position and disposed within said housing, said stationary and movable contacts being connected in series circuit relationship to said first pair of disconnecting contacts;

second operating means connected to said movable contact for moving said movable contact to an open position when current through the motor controller exceeds a predetermined level; and third operating means connected to said movable contact for moving said movable contact to the open or closed position during normal motor control operation, and for moving said movable contact to the open position for overload currents below the predetermined level;

operation of said first pair of disconnecting contacts being operable to electrically isolate said stationary and movable contacts from the source of high potential.

9. A motor controller as claimed in claim 8 wherein said second operating means comprises:

a movable contact arm having said movable contact mounted thereto; and a magnetic drive device comprising a ferromagnetic material having a slot formed therein, within which slot a portion of said movable contact arm is disposed.

10. A motor controller as claimed in claim 9 wherein said thrid operating means comprises:

a solenoid;

a currnt transformer disposed in series with said movable contact and said stationary contact; and control logic means connected to said current transformer and said solenoid for deactivating said solenoid when current flow exceeds a predetermined value less than the predetermined overload current level.

11. A motor controller as claimed in claim 10 wherein:

said movable contact arm is supported for rectilinear movement; and comprising, a plurality of metal plates disposed in proximity to said movable contact and said stationary contact.

12. A motor starter disposed within a housing comprising:

stationary contact means;

movable contact means movable into and out of engagement with said stationary contact means;

a solenoid operably associated with said movable contact means for normal motor controlling copening and closing movement thereof and for opening movement thereof when overcurrent flow is below a predetermined value;

magnetic driving means magnetically coupled to said movable contact means for driving said movable contact means out of engagement with said stationary contact means for all current flow above the predetermined value; and a disconnect means connected in series with said stationary contact means and said movable contact means for electrically isolating said stationary and movable contact means.

13. A motor starter as claimed in claim 12 comprising:

a current monitor disposed within said motor starter providing a signal which is a function of the current value; and solid state trip means connected between said current monitor and said solenoid for causing said solenoid to move said movable contact out of engagement position when current flow through the motor starter exceeds a selected level.

14. A modular motor starter comprising:

a stationary contact;

a movable contact, movable into and out of engagement with said stationary contact;

a first operator disposed for positioning said movable contact when current flow through the modular motor starter is below a predetermined level;

a second operator disposed for positioning said movable contact out of engagement with said stationary contact when current flow through the modular motor starter is above the predetermined level;

a first modular section having said movable contact and said second operator supported thereon; and a second modular section, engageable with said first modular section, and supporting said stationary contact and said first operator.

15. A modular motor starter as claimed in claim 14 comprising:

a disconnect switch having movable contact blade and a spring clip contact for engaging the movable contact blade when said disconnect switch is closed said disconnect switch being connected in series circuit relationship with said stationary and movable contacts;

said first modular section having the spring clip contact mounted thereon; and said second modular section having the movable contact blade mounted thereon.

16. A modular motor starter as claimed in claim 15 comprising:

an incoming terminal connected to the spring clip contact; and a shutter operable between open and closed positions, said shutter being spring biased to a closed position shielding said spring clip contact when said second modular section is not in engagement with said first modular section, whereby said stationary and movable contacts are physically and electrically isolated from said incoming terminal and said spring clip contact.

* * * * *